US007851750B2

(12) United States Patent
Reilly

(10) Patent No.: US 7,851,750 B2
(45) Date of Patent: Dec. 14, 2010

(54) MASS INDEPENDENT KINETIC ENERGY REDUCING INLET SYSTEM FOR VACUUM ENVIRONMENT

(75) Inventor: Peter T. A. Reilly, Knoxville, TN (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 295 days.

(21) Appl. No.: 12/100,001

(22) Filed: Apr. 9, 2008

(65) Prior Publication Data

US 2009/0256072 A1 Oct. 15, 2009

(51) Int. Cl.
*H01J 49/00* (2006.01)

(52) U.S. Cl. ..... 250/288

(58) Field of Classification Search ..... 250/288, 250/251, 281, 282

See application file for complete search history.

(56) References Cited

U.S. PATENT DOCUMENTS 6,972,408 B1 12/2005 Reilly
7,476,851 B2 * 1/2009 Wang et al. ..... 250/288
2003/0150984 A1 8/2003 Guevremont et al.
2005/0269506 A1 12/2005 Kalinitchenko
2006/0118715 A1 6/2006 Schneider et al.

* cited by examiner

*Primary Examiner*—Kiet T Nguyen
(74) *Attorney, Agent, or Firm*—Scully, Scott, Murphy & Presser, P.C.

(57) ABSTRACT

A particle inlet system comprises a first chamber having a limiting orifice for an incoming gas stream and a micrometer controlled expansion slit. Lateral components of the momentum of the particles are substantially cancelled due to symmetry of the configuration once the laminar flow converges at the expansion slit. The particles and flow into a second chamber, which is maintained at a lower pressure than the first chamber, and then moves into a third chamber including multipole guides for electromagnetically confining the particle. The vertical momentum of the particles descending through the center of the third chamber is minimized as an upward stream of gases reduces the downward momentum of the particles. The translational kinetic energy of the particles is near-zero irrespective of the mass of the particles at an exit opening of the third chamber, which may be advantageously employed to provide enhanced mass resolution in mass spectrometry.

22 Claims, 7 Drawing Sheets

MASS INDEPENDENT KINETIC ENERGY REDUCING INLET SYSTEM FOR VACUUM ENVIRONMENT

STATEMENT REGARDING FEDERALLY SPONSORED RESEARCH OR DEVELOPMENT

This invention was made with government support under Contract No. DE-AC05-00OR2725 awarded by the U.S. Department of Energy. The government has certain rights in this invention.

FIELD OF THE INVENTION

The present invention relates to a particle inlet system for delivering near-zero kinetic energy particles into vacuum environment, which may contain an analytical instrument such as a mass spectrometer, and methods of operating the same.

BACKGROUND OF THE INVENTION

Whenever a particle or molecule is expanded into vacuum, the expansion imparts translational kinetic energy into the particle that monotonically increases with mass. For some analytical instruments that operate under vacuum, such translational kinetic energy may pose limitations on the capability of the analytical instrument. This is particularly true of mass spectrometers, in which the initial translational kinetic energy competes with the electric and magnetic fields of the mass spectrometer such that the instrumental resolution is adversely affected by the translational kinetic energy that the particle acquires in the process of expansion into vacuum.

The greater the mass of the particle, the greater the expansion induced kinetic energy. But the energy imparted to the particle through the electromagnetic field is proportional only to the charge of the particle and the magnitude of the electrical field, and is independent of the mass of the particle. As the mass of the particle increases, the effect of the expansion induced kinetic energy competes with, and eventually overwhelms, the effect of the electrical potential in the mass spectrometer that is applied to define the trajectory of charged particles. For this reason, it is very difficult to measure the mass of the large molecules or particles, e.g., molecules or particles having a molecular weight of 10 kDa, by mass spectrometry.

A prior art solution to this problem, as disclosed by U.S. Pat. No. 6,972,408 to Reilly, provides mass-dependent slowing of particles, i.e., the particles are slowed for a limited range of particle mass. The size or mass of the particles effectively slowed depends on the pressure of the reverse jet expansion.

In view of the above, there exists a need for a particle inlet system into the vacuum environment that provides a reduction of expansion-induced kinetic energy with a reduced mass dependence, and methods of operating the same.

Further, there exists a need for a particle inlet system into vacuum environment that provides a large range of particles masses to be slowed for subsequently introduction into the vacuum environment such as a mass spectrometer, and methods of operating the same.

SUMMARY OF THE INVENTION

The present invention addresses the needs described above by providing a particle inlet system in a configuration that permits a large range of particle masses to be slowed for subsequent introduction into the vacuum environment.

According to the present invention, a particle inlet system comprises a first chamber having a limiting orifice for an incoming gas stream and a micrometer controlled expansion slit having a center concentric with the center of a micrometer shaft. The laminar flow has a 180° rotational symmetry at the expansion slit so that lateral components of the momentum of the particles are substantially cancelled once the laminar flow converges at the expansion slit. The particles flow into a second chamber, which is maintained at a lower pressure than the first chamber, and then moves into a third chamber including multipole guides for electromagnetically confining the particle. The third chamber is generally maintained at a positive pressure relative to the second chamber. The vertical and radial momentum of the particles descending through the center of the third chamber is reduced by collisions with the buffer gas until their motion becomes random. These particles are said to be stopped and are free of their expansion-induced kinetic energy. If the particles have a charge their motion will then be defined by the applied electric fields of the multipole and the endcap electrodes. These particulate ions can then be collimated with a multipole guide or trapped with potentials applied to the endcap electrodes and subsequently injected on-demand into a mass spectrometer. Under these conditions, the motion of the particulate ions is completely define by the applied fields. As such their masses can then be measured with accuracy and resolution that is define by the limitations of the mass analyzer and not the expansion-induced kinetic energy. The advantage of this inlet is that it permits an extraordinarily large range of particle sizes or masses to delivered to the mass spectrometer without the initial expansion-induced kinetic energy.

According to an aspect of the present invention, a particle inlet system for vacuum instrumentation is provided. The particle inlet system comprises:

a first chamber having a gas inlet orifice and an expansion slit located over a plate containing a first opening, wherein a height of the expansion slit is adjustable in a direction along an direction perpendicular to a flat surface of the plate;

a second chamber connected to the first chamber at the first opening and having a second opening located directly underneath the first opening; and a vacuum pump connected to, and configured to pump on, the second chamber.

A third chamber may be connected to the second chamber at the second opening.

In one embodiment, the first opening has a shape with a 180 degree rotational symmetry around an axis perpendicular to the flat surface.

In another embodiment, the particle inlet system further comprises a micrometer, wherein a spindle of the micrometer is located over the first opening and a thimble of the micrometer is located outside the first chamber.

In even another embodiment, the particle inlet system further comprises an expansion chamber located between the first chamber and the second chamber and including first-chamber-side openings and at least one second-chamber-side opening, wherein said first-chamber-side openings are located on sidewalls of said expansion chamber with a 360/n degree rotational symmetry, wherein n is an integer greater than 1. The at least one second-chamber-side opening may have a 360/m degree rotational symmetry about a same axis of rotational symmetry as the first-chamber-side openings, wherein m is an integer greater than 1.

In yet another embodiment, the particle inlet system fifth comprises a buffer gas inlet connected directly to the third chamber.

In still another embodiment, the particle inlet system further comprises:

a fourth chamber connected to the third chamber through a third opening, wherein the third opening is located on an opposite side of the second opening on the third chamber; and another vacuum pump connected to, and configured to pump on, the fourth chamber.

According to another aspect of the present invention, a mass spectrometry system is provided, which comprises:

a first chamber having a gas inlet orifice and an expansion slit located over a plate containing a first opening, wherein a height of the expansion slit is adjustable in a direction along an direction perpendicular to a flat surface of the plate;

a second chamber connected to the first chamber at the first opening and having a second opening located directly underneath the first opening;

a vacuum pump connected to, and configured to pump on, the second chamber;

a third chamber having a third opening and connected to the second chamber at the second opening;

a fourth chamber connected to the third chamber at the third opening; and a mass spectrometer located in the fourth chamber.

In one embodiment, the mass spectrometry system further comprises a micrometer, wherein a spindle of the micrometer is located over the first opening and a thimble of the micrometer is located outside the first chamber.

In another embodiment, the first opening, the second opening, and the third opening are aligned on a same axis.

In even another embodiment, the mass spectrometry system further comprises a micrometer, wherein an axis of the spindle of the micrometer is coincidental with the same axis.

According to yet another aspect of the present invention, a method of operating a particle inlet system is provided, which comprises:

providing a particle inlet system including a first chamber having a gas inlet orifice and an expansion slit located over a plate containing a first opening, a second chamber connected to the first chamber at the first opening and having a second opening located directly underneath the first opening, and a third chamber connected to the second chamber at the second opening;

inducing a laminar flow of particles within the first chamber, wherein the first chamber provides a 180 degree rotational symmetry about a center of the first opening in a pattern of the laminar flow at the expansion slit; and flowing a buffer gas into the third chamber, wherein the particles are slowed within the third chamber upon entry through the second opening into the third chamber.

In one embodiment, the method further comprises maintaining the first chamber at a first pressure and the second chamber at a second pressure, wherein the second pressure is lower than the first pressure.

In another embodiment, the particles flow into a fourth chamber through a third opening in the third chamber, wherein the second opening is located in a first chamber wall of the third chamber, wherein the third opening is located on a second chamber wall of the third chamber located on an opposite side of the first chamber wall, and wherein the fourth chamber contains at least one vacuum instrumentation.

In even another embodiment, the method further comprises adjusting a first pressure of the first chamber by changing a height of the expansion slit.

In yet another embodiment, the particle inlet system further comprises a micrometer, a spindle of the micrometer is located over the first opening and a thimble of the micrometer is located outside the first chamber, and the method further comprises adjusting a first pressure of the first chamber by adjusting a distance between the spindle and the plate.

In still another embodiment, the method further comprises guiding the particles within the third chamber with a multipole ion guide located in the third chamber.

In a further embodiment, the method further comprises altering speed or trajectory of the particles within the third chamber by an electromagnetic field generated by at least one electrode located within the third chamber.

According to still another aspect of the present invention, another particle inlet system for vacuum instrumentation is provided. The particle inlet system comprising:

a first chamber including a gas inlet orifice, a first opening, and a plurality of plates, wherein each of the plurality of plates has a plate opening therein and is located between the gas inlet orifice and the first opening, wherein the gas inlet orifice, an entirety of the plate openings, and the first opening are coaxially aligned;

a second chamber connected to the first chamber at the first opening, having a second opening, and containing a multipole ion guide and, wherein the first opening and the second opening are aligned to a center axis of the multipole ion guide; and a conical jet nozzle having a ring-shaped opening around the second opening, wherein the conical jet nozzle concentrically points toward the center axis of the multipole ion guide;

In one embodiment, the particle inlet system further comprises a jet nozzle housing embedding the conical jet nozzle, wherein the jet nozzle housing includes an upper plate exposed to the second chamber, a lower plate separated from the upper plate by the conical jet nozzle, and a toroidal outer frame adjoined to the upper plate and the lower plate and enclosing a toroidal gas chamber radially connected to the conical jet nozzle.

In another embodiment, the particle inlet system further comprises:

a third chamber connected to the second chamber through the second opening; and a vacuum pump connected to, and configured to pump on, the third chamber.

In yet another embodiment, the particle inlet system further comprises at least one electrode containing an electrode hole aligned to the center axis and located within the second chamber.

According to a further aspect of the present invention, a method of operating a particle inlet system for vacuum instrumentation is provided. The method comprises:

providing a directional particle beam from a first chamber into a second chamber, wherein the first chamber comprises a gas inlet orifice, a first opening, and a plurality of plates having a plate opening therein and located between the gas inlet orifice and the first opening, wherein the gas inlet orifice, an entirety of the plate openings, and the first opening are coaxially aligned, and wherein particles move from the gas inlet orifice through the plate openings and to the first opening;

focusing the direction particle beam in the second chamber with a multipole ion guide located within the second chamber, wherein the directional particle beam moves through the multipole ion guide and exits the second chamber through a second opening into a third chamber; and providing a reverse jet through a conical jet nozzle having a ring-shaped opening around the second opening, wherein momentum of the directional particle beam is counterbalanced by momentum of the reverse jet, whereby the directional particle beam loses kinetic energy before entry into the third chamber.

In one embodiment, the method further comprises pumping the second chamber with a vacuum pump, wherein the second chamber is maintained at a lower pressure relative to the first chamber.

In another embodiment, the vacuum instrumentation includes a mass spectrometer located in the third chamber.

DETAILED DESCRIPTION OF THE INVENTION

Figure 1:
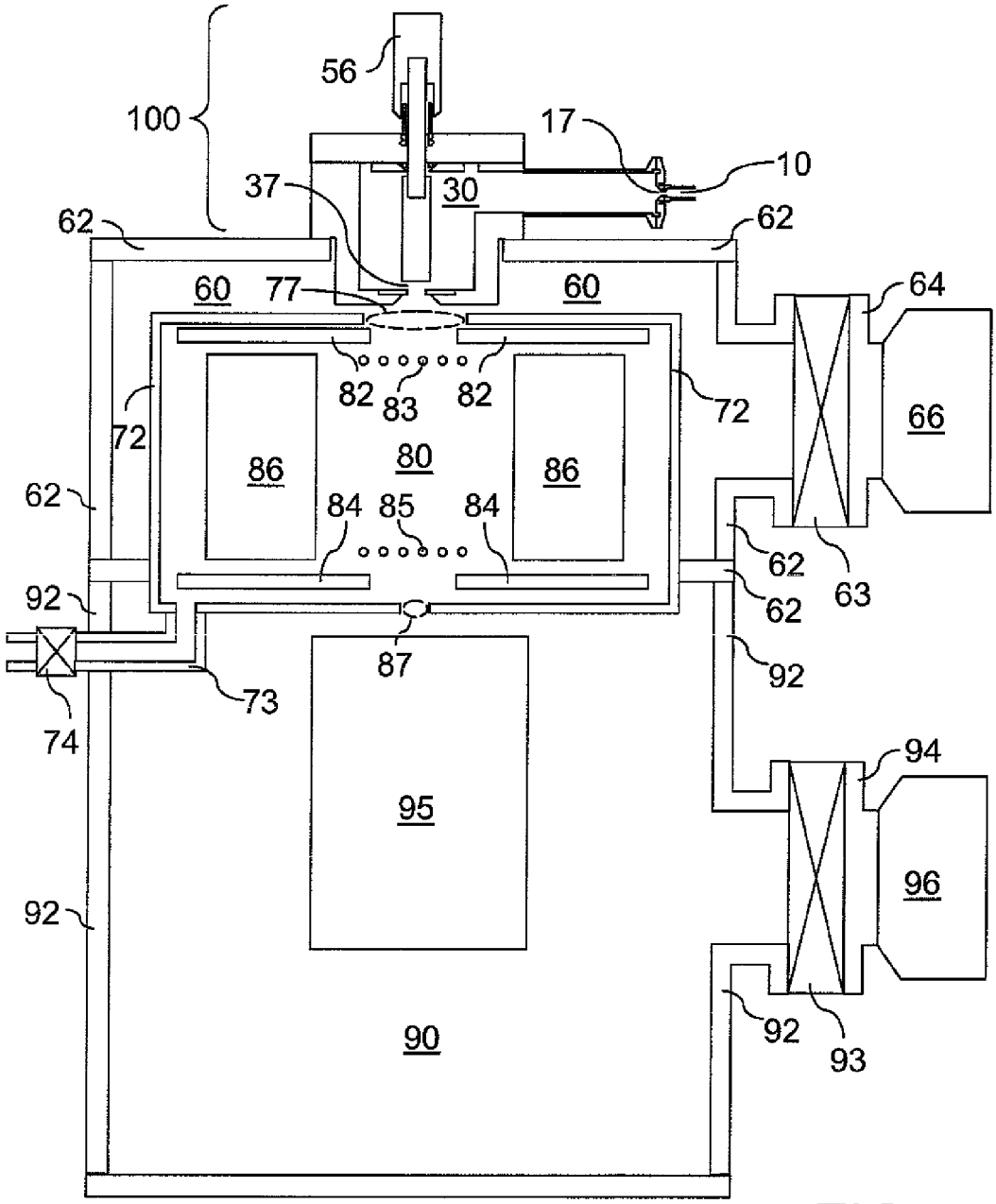
FIG. 1 is a vertical cross-sectional view of a first exemplary particle inlet system comprising a first chamber 30, a second chamber 60, a third chamber 80, and a fourth chamber 80 housing vacuum instrumentation 95 according to a first embodiment of the present invention.

As stated above, the present invention relates to a particle inlet system for delivering near-zero kinetic energy particles into vacuum environment, which may contain an analytical instrument such as a mass spectrometer, and methods of operating the same, which are now described in detail with accompanying figures. It is noted that like and corresponding elements mentioned herein and illustrated in the drawings are referred to by like reference numerals. It is also noted that proportions of various elements in the accompanying figures are not drawn to scale to enable clear illustration of elements having smaller dimensions relative to other elements having larger dimensions.

Figure 2:
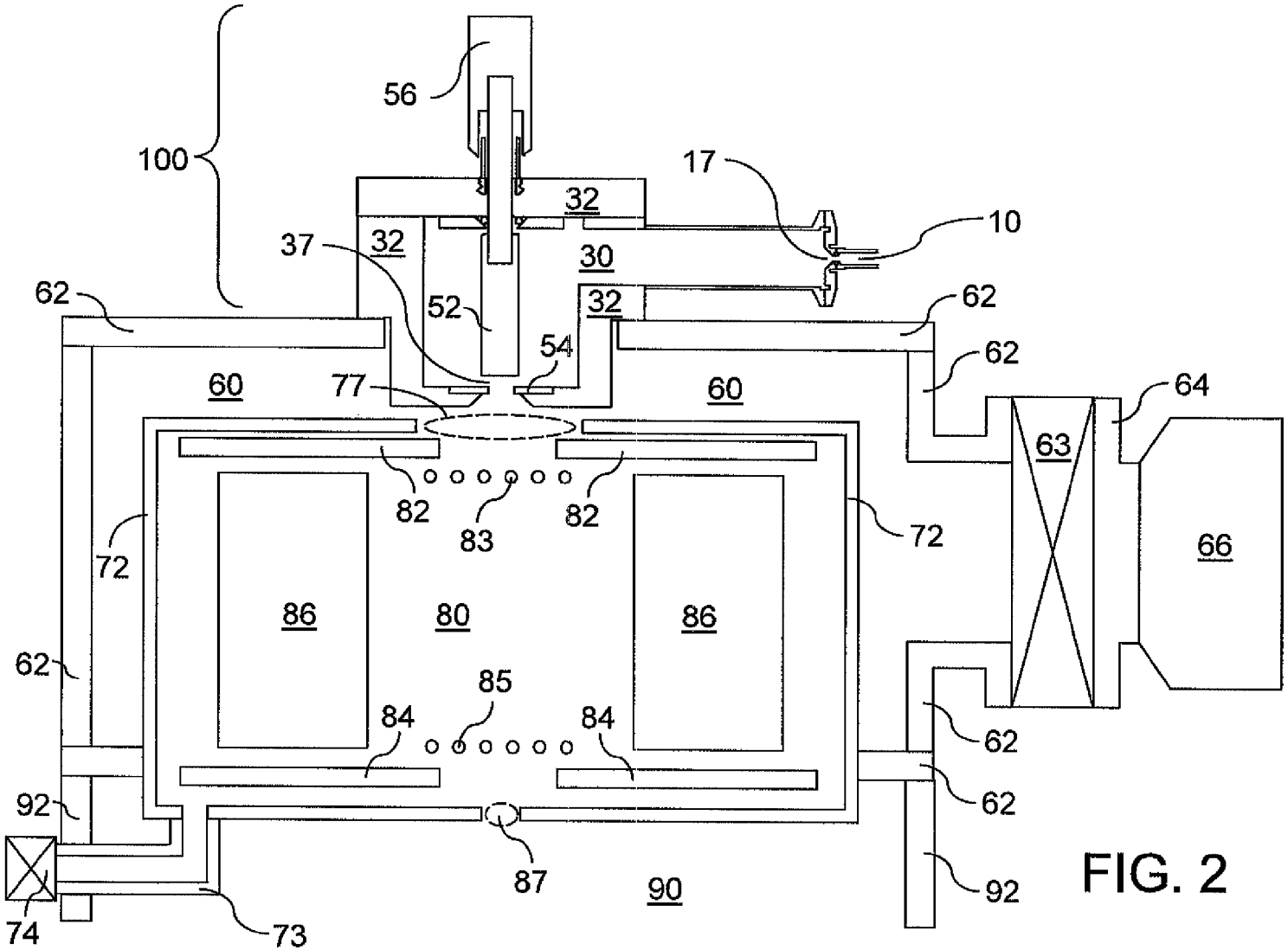
FIG. 2 is a magnified view of the first exemplary particle inlet system of the first chamber 30, the second chamber 60, and the third chamber 80 according to the first embodiment of the present invention. The fourth chamber 80 is partially shown in FIG. 2.
Figure 3:
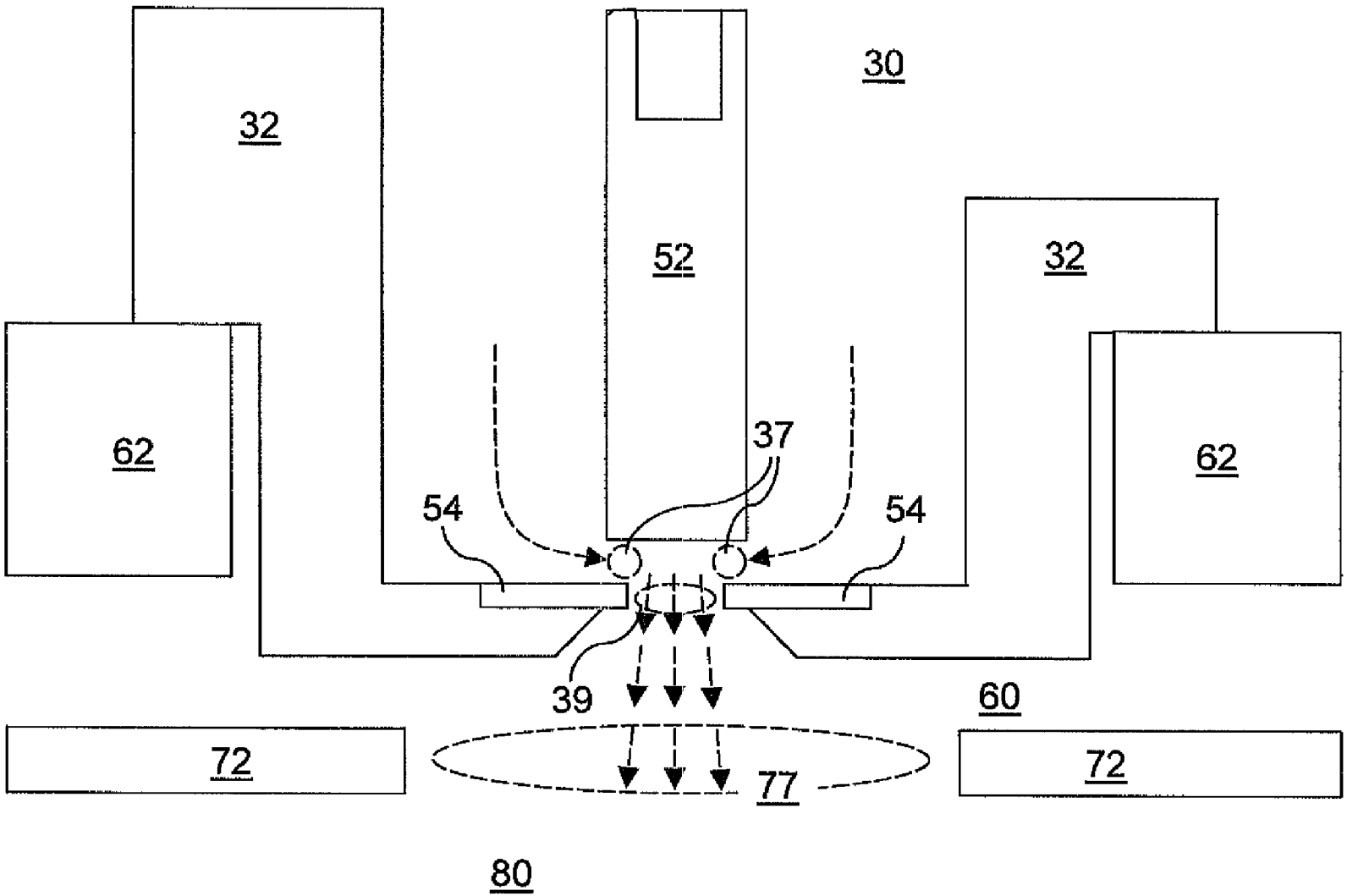
FIG. 3 is a magnified vertical cross-sectional view of the first exemplary particle inlet system around a plate 54 containing a first opening 39 and a second opening 77 according to the first embodiment of the present invention.

FIGS. 1-3 illustrate a first exemplary particle inlet system according to a first embodiment of the present invention. FIGS. 1-3 are vertical cross-sectional views with different magnifications. Specifically, FIG. 1 shows the entirety of the first exemplary particle inlet system including a first chamber 30, a second chamber 60, a third chamber 80, and a fourth chamber 80 housing vacuum instrumentation 95. FIG. 2 shows a magnified view of the first chamber 30, the second chamber 60, and the third chamber 80. FIG. 3 shows the first exemplary particle inlet system around a plate 52 containing a first opening 39 and a second opening 77.

The first exemplary particle inlet system is employed to deliver near-zero kinetic energy particles into the fourth chamber 80 which houses the vacuum instrumentation 95. The vacuum instrumentation 95 may be any type of vacuum compatible instrument, and may be an analytical device. Preferably, the vacuum instrumentation 95 is a vacuum compatible instrument that benefits from low kinetic energy of particles. Particularly, the vacuum instrumentation 95 may be a mass spectrometer, of which the resolution is enhanced when the kinetic energy of the particles is lowered. When the kinetic energy of the particles is near-zero as in the present invention, the mass spectrometer provides high resolution even for particles having a high atomic mass, e.g., over 200 kDa.

An aerosol of particles is introduced with a carrier gas from a gas inlet assembly 10 through a gas inlet orifice 17 into the first chamber 30 of the first exemplary particle inlet system. Preferably, the gas inlet orifice 17 is a flow limiting orifice. The dimension, e.g., a diameter, of the gas inlet orifice 17 may be from about 10 μm to about 1 mm, and typically from about 30 μm to about 300 μm, although lesser and greater dimensions are contemplated herein also. The particles may, or may not, be charged when admitted into the first chamber 30. In case the vacuum instrumentation 95 comprises a mass spectrometer, the particles are preferably electrically charged prior to entry into the first chamber 30. The aerosol of particles expands into the first chamber 30 at a reduced pressure, i.e., at a lower pressure than the pressure at the gas inlet assembly 10, which may be at an atmospheric pressure. The velocities of the particles and the carrier gas come into equilibrium in the first chamber 30, which is also referred to as a plenum chamber, so that the particles and the carrier gas form a laminar flow.

The first chamber 30 is enclosed by first chamber walls 32, and is connected to the gas inlet assembly 10 through the gas inlet orifice 17 and to the second chamber 60 through a first opening 39 (See FIG. 3), which is located within a plate 54. The plate 54 may be embedded in one of the first chamber walls 32. Other than the gas inlet orifice 17 and the first opening 39, the first chamber 30 is vacuum tight.

A micrometer 100 is provided on the first chamber 30. The micrometer 100 includes a thimble 56 located on the outside of the first chamber and a spindle 52 located inside the first chamber 30. The spindle 52 is vertically movable in the direction of the axis of the spindle 52 by tuning of the thimble 56 of the micrometer 100. The spindle 52 is located over the first opening 39, and the end surface of the spindle 52 is parallel to the surface of the plate 54 so that the first opening may be sealed by the movement of the spindle 52. The spindle 52 may be a cylinder of a constant horizontal cross-sectional shape, which has a 180 degree rotational symmetry. Preferably, the spindle 52 comprises a circular cylinder.

An adjustable expansion slit 37 is formed between the face of the plate 54 toward the first chamber 30 and the end surface of the spindle 52 when the setting of the thimble 56 of the micrometer 100 does not make the end face of the spindle 52 directly contact the face of the plate 54, thereby sealing the first chamber 30 from the second chamber 60. The height of the "adjustable" expansion slit 37 is adjustable by sliding the spindle 52 of the micrometer 100 toward, or away from, the face of the plate 54. The maximum distance that the spindle 52 may travel vertically may be from about 3 mm to about 3 cm, and typically from about 6 mm to about 1.5 cm, although lesser and greater distances are contemplated herein also. The distance resolution of the distance of the spindle 52 from the face of the plate 54, i.e., the height of the adjustable expansion slit 37, is preferably on the order of one millimeter. The control of the height of the adjustable expansion slit 37 enables a precise control of the pressure drop across the adjustable expansion slit 37, which is an expansion orifice, over a wide pressure range. While cylindrical symmetry of the adjustable expansion slit 37 and the first opening 39 is preferred, the present invention may be practiced with different geometric shapes as long as a 180 degree rotational symmetry is provided to the flow of particles and carrier gas molecules.

The adjustable "expansion" slit 37 induces expansion of the aerosol of particles since the second chamber 60 is pumped by a second chamber vacuum pump 66, which is mounted to second chamber walls 62 through a second chamber mounting flange 64 and a second chamber gate valve 63, while no pump is directly mounted on the first chamber 30. To reduce load on the second chamber vacuum pump 66, the second chamber gate valve 63 is typically operated at a partially open state. The pressure of the first chamber 30, which is herein referred to as a first pressure, is higher than the pressure of the second chamber 60, which is herein referred to as a second pressure. The aerosol of particles, which form a laminar flow in the first chamber 30, expands as it flows into the second chamber 60. Typically, the first pressure is maintained in the range from about 70 mTorr to about 1 atm, and the second pressure is maintained in the range from about 1 mTorr to about 100 mTorr, although lesser and greater values are contemplated for the first pressure and the second pressure also. The first pressure and the second pressure may be measured by pressure gauges. The adjustable expansion slit 37 is an inward expansion slit since the laminar flow of the particles and carrier gases in the first chamber 30 expands as they cross over the adjustable expansion slit 37 from the outside of the circumference that defines the adjustable expansion slit 37 to the inside of the circumference.

The adjustable expansion "slit" 37 limits flow of the aerosol of the particles, and has a shape of a slit having a geometry in which the height of the slit is less than the circumference of the slit. In case the spindle 52 has the shape of a circular cylinder, the adjustable expansion slit 52 has a circular circumference having the same diameter as the diameter of the spindle 52. In other words, the adjustable expansion slit 37 has a shape of a sidewall surface of a circular cylinder having a radius equal to a radius of the spindle 52 of the micrometer 100. The diameter of the spindle may be from about 1.5 mm to about 15 cm, and typically from about 6 mm to about 4 cm, although lesser and greater diameters are also contemplated herein. In this case, the adjustable expansion slit 37 is axially symmetric, i.e. has an axial symmetry around the axis of the spindle 52, and has a toroidal shape. The aerosol of particles undergoes an axially symmetric inward expansion as it passes from the first chamber 30 through the adjustable expansion slit 37. The expansion then rebounds off of itself and undergoes another expansion in the normal direction toward the first opening 39. The particles in the expansion also rebound regardless of size and are slowed in the radial direction but may rebound more than once. Eventually, enough axial momentum is imparted for them to escape through opening 39 or deposit on a surface. The direction of the movement of the particles is schematically illustrated in FIG. 3 by dotted arrows.

Particles and carrier gas molecules expanding through one side of the adjustable expansion slit 37 encounter other particles and other carrier gas molecules expanding through the opposite side of the adjustable expansion slit 37. The lateral momentum of the particles and the carrier gas molecules cancel out as they converge at the center of the adjustable expansion slit 37 in the shape of the toroid. The lateral momentum of the particles as they enter the second chamber 60 through the first opening 39 is thus substantially decreased. Depending on the vertical momentum of the particles after the flow of the particles and the carrier gas molecules collide at the axis of the spindle 52 of the micrometer 100, the particles are entrained into a flow of the particles in the direction orthogonal to the radius of the adjustable expansion slit 37, i.e., orthogonal to the end surface of the spindle 52. Due to the loss of all lateral momentum, particles after the expansion at the adjustable expansion slit 37 have a much reduced velocity compared to the particles in the first chamber 30.

Figure 4B:
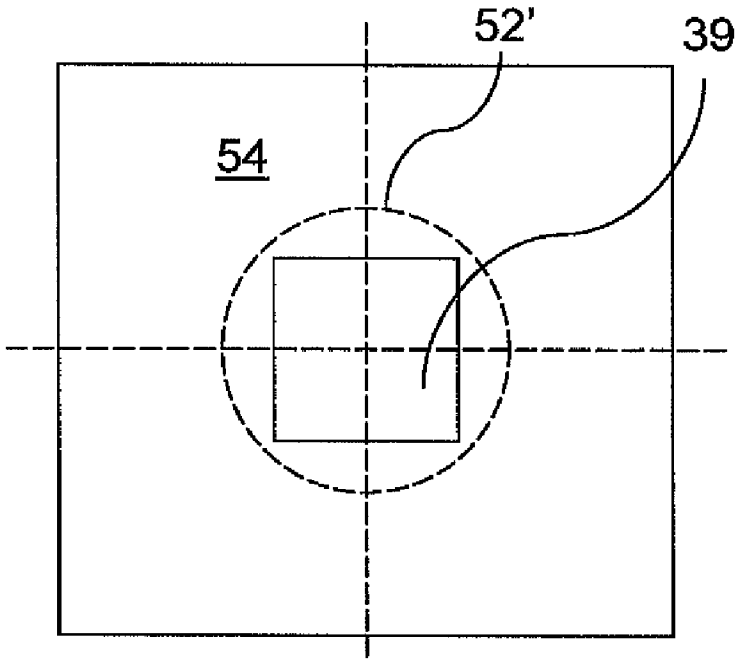
FIGS. 4A and 4B are exemplary shapes for the plate 54 and the first opening 39 contained therein in the first exemplary particle inlet system according to the first embodiment of the present invention.
Figure 4A:
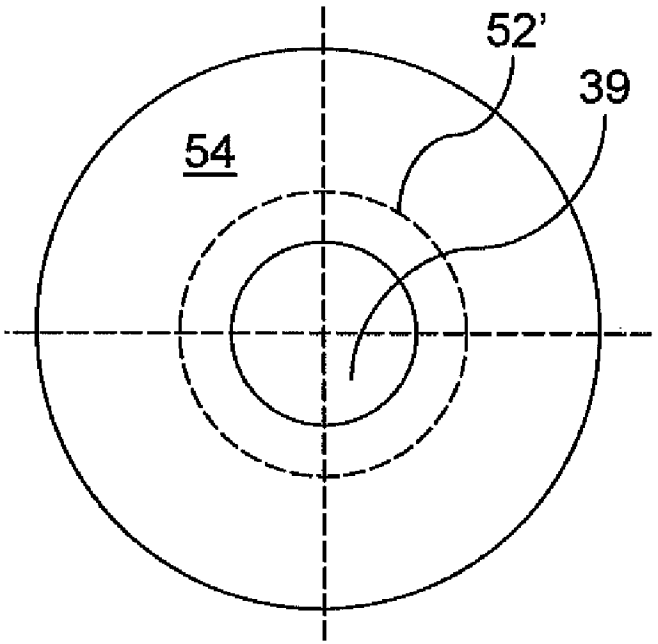

FIG. 4A shows a top-down view of a first exemplary shape for the plate 54, the first opening 39, and the areal projection 52' of the spindle 52 in the first exemplary particle inlet system. FIG. 4B shows a top-down view of a second exemplary shape for the plate 54, the first opening 39, and the areal projection 52' of the spindle 52 in the first exemplary particle inlet system.

Preferably, the first opening 39 has a shape with a 180 degree rotational symmetry around an axis perpendicular to the face, which is a flat surface of the plate 54. The 180 degree rotational symmetry insures that the opening does not introduce any symmetry breaking as the particles and the carrier gas molecules collide at the axis of the spindle 52 of the micrometer 100, thereby cancellation of lateral momentum of the particles and the carrier gas molecules is near complete. The shape of the first opening 39 may be a circle, an ellipse, a square, a rectangle, a polygon having an even number of sides, or any other geometric shape having a 180 degree rotational symmetry around an axis through the center of the geometric shape. Preferably, the shape of the first opening 39 is a circle having a diameter, which may be from about 1 mm to about 10 cm, and typically from about 3 mm to about 3 cm, although lesser and greater diameters are contemplated herein also.

The center of the geometric shape coincides with the axis of the spindle 52 of the micrometer 100. In other words, the first opening 39 and the spindle 52 of the micrometer 100 are coaxially aligned.

Figure 5B:
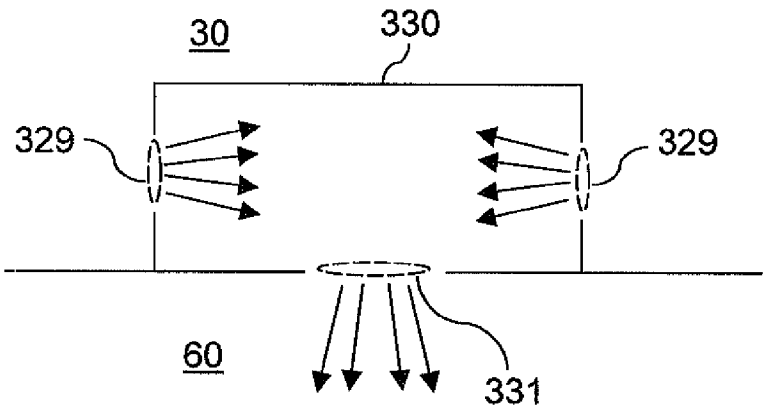
FIG. 5B is a vertical cross-sectional view of the exemplary expansion chamber of FIG. 5A.
Figure 5C:
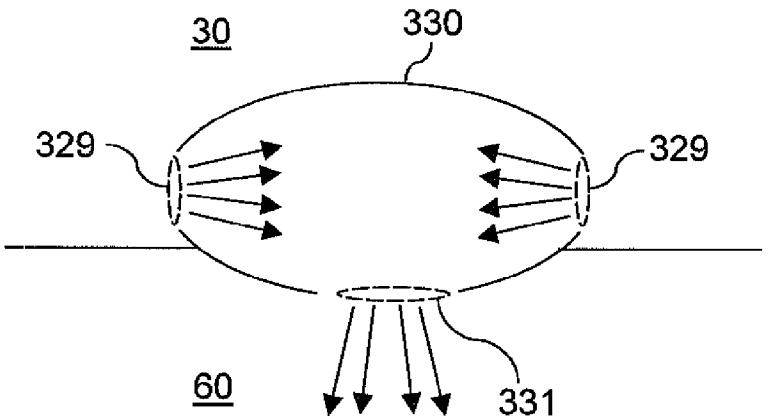
FIG. 5C is an alternate vertical cross-sectional view of the exemplary expansion chamber of FIG. 5A.
Figure 5A:
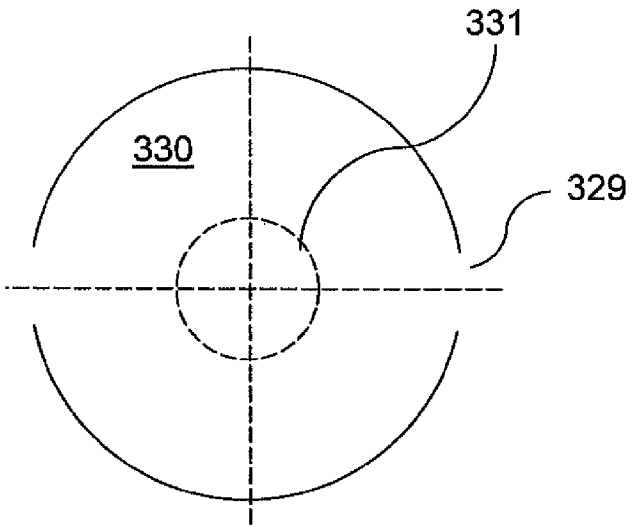
FIG. 5A is a top-down view of an exemplary expansion chamber that may be employed instead of the first opening 39 and the micrometer of FIGS. 1-4.

In a variation of the first embodiment of the present invention, the first opening 39 and the micrometer may be replaced by an expansion chamber having two sets of openings. FIG. 5A is a top-down view of an exemplary structure for an expansion chamber 330. FIGS. 5B and 5C are alternate vertical cross-sectional views of the exemplary structure for the expansion chamber 330 of FIG. 5A.

The expansion chamber 330 is located between the first chamber 30 and the second chamber 60, and provides a path for particles to pass from the first chamber 30 to the second chamber 60. First-chamber-side openings 329 are located on sidewalls of the expansion chamber 330 with a 360/n degree rotational symmetry to induce cancellation of average lateral momentum of the particles that enter the expansion chamber 330, in which n is an integer greater than 1. For example, the expansion chamber 330 may have two first-chamber-side openings 329 located on opposite ends, in which case the number n is equal to 2. The expansion chamber 330 may have three first-chamber-side openings 329 separated by 120 degrees therebetween, in which case the number n is equal to 4. In general, the expansion chamber 330 may have n of first-chamber-side openings 329, which are separated by 360/n degrees therebetween and the number n is any integer greater than 1.

Further, the expansion chamber 300 may have any additional set of first-chamber-side openings 329 provided that each of the first-chamber-side openings 329 have a 360/n' degree rotational symmetry, in which n' is an integer greater than 1. n' may, or may not, be the same as n.

The expansion chamber 330 also has at least one second-chamber-side opening 331, which provides a path for particles to move from inside the expansion chamber 330 to the second chamber 60. The number of holes in the at least one second-chamber-side opening 331 may be 1, or a number greater than 1. Preferably, the shape of the at least one second-chamber-side opening 331 has a 360/m degree rotational symmetry about the same axis of the rotational symmetry for the first-chamber-side openings 329. m is an integer greater than 1. The shape of the at least one second-chamber-side opening 331 may have an axial symmetry about the same axis of the rotational symmetry for the first-chamber-side openings 329. The dimensions of the at least one second-chamber-side opening 331 may be about the same as the dimensions of the first opening 39 described above.

The particles move through the second chamber 60 into a third chamber 80 through a second opening 77 provided within one of third chamber walls 72 that enclose the third chamber 80. The distance between the first opening 39 and the second opening 77 may be from about 1 mm to about 15 cm, and typically from about 5 mm to about 5 cm, although lesser and greater distances are contemplated herein also. The shape of the second opening 77 may, or may not, have a 180 degree rotational symmetry. Preferably, the shape of the second opening 77 has a 180 degree rotational symmetry. The center of the second opening 77, if definable, is preferably aligned to the center of the first opening 39. The size of the second opening 77 is greater than the size of the first opening. The dimension, e.g., the diameter, of the second opening 77 may be from about 3 mm to about 30 cm, and typically from about 1 cm to about 10 cm, although lesser and greater thicknesses are contemplated herein also.

The particles subsequently move through the third chamber 80 to a third opening 87 located in another of the third chamber walls 72. The third opening 87 is located on an opposite side of the second opening 77. The first opening 39, the second opening 77, and the third opening 87 may be located on a same axis, which preferably coincides with the axis of the spindle 52 of the micrometer 100. A fourth chamber 90 is connected to the third chamber 80 through the third opening 87. The fourth chamber 90 comprises vacuum instrumentation 95, which may be, for example, a mass spectrometer. A fourth chamber vacuum pump 96 is connected to fourth chamber walls 92 through a fourth chamber mounting flange 94 and a fourth chamber gave valve 93. Typically, the fourth chamber gate valved 93 is operated at a fully open state to provide high vacuum to the fourth chamber 90.

For the purposes of application of the first exemplary particle inlet system in a mass spectrometry system, charged particles are employed for injection into the first chamber 30, and subsequent flow into the second chamber 60, the third chamber 80, and the fourth chamber 90. A multipole ion guide 86 is provided within the third chamber 80. The multipole ion guide 86 guides comprises a plurality of poles surrounding a central cavity through which charged ions move. A set of electrical feedthroughs (not shown) are connected to the electrodes of the multipole ion guide 86. The central cavity in the multipole ion guide 86 is preferably aligned to an axis connecting the second opening 77 to the third opening 87, i.e., the center axis of the multipole ion guide 86 coincides with axis that connects the second opening 77 to the third opening 87. By applying a time dependent electrical potential to the poles with appropriate phase differences, the ions are dynamically confined around the central cavity. The frequency, the amplitude, and the phase of the electrical potential depend on the geometry of the multipole ion guide 86. Operational principles of multipole ion guides are known in the art. The charged particles move down the central cavity of the multipole ion guide around the axis of the multipole ion guide 86.

The charged particles that move into the third chamber 80 may still have some lateral momentum since the cancellation of the lateral momentum during convergence of the charged particles at the axis of the adjustable expansion slit 37 is statistical. In other words, while the average lateral momentum of the particles is zero, the individual particles may have a distribution of non-zero lateral momentum. Thus, the charged particles entering the center cavity of the multipole ion guide 86 may be somewhat divergent, i.e., not collimated. However, the electromagnetic field of the multipole ion guide 86 focuses the charged particles as a directional beam along the central axis of the multipole ion guide 86. The diameter of the central cavity of the multipole ion guide 86, i.e., the diameter of a maximal circle that fits within the central cavity of the multipole ion guide 86, may be from about 1 mm to about 1 m, and typically from about 5 mm to about 20 cm, although lesser and greater diameters are contemplated herein also. In practice, a multipole ion guide 86 having a large diameter tends to provide greater stopping distances to any divergent charged ions and capture heavier charged particles.

Control of the expansion of particles from the first chamber 30 through the adjustable expansion slit 37, the first opening 39, the portion of the second chamber 60 between the first opening 39 and the second opening 77, the second opening 77, and into the central cavity of the multipole ion guide 86 in the third chamber 80 is accomplished by optimizing the geometry of the adjustable expansion slit 37. Such optimization may be done with fluid dynamics calculations. The primary control variables of this type of calculation are the lateral area of the adjustable expansion slit 37 for the inward expansion and the dimension, e.g., the diameter, of the third chamber 80. The height and the circumference of the adjustable expansion slit 37 and the area of the first opening 39, which is an expansion orifice, can be adjusted to optimize charged particle capture in the third chamber 80.

A buffer gas inlet 73 is provided on one of the third chamber walls 72 located on the same side of the third chamber 80 as the third opening 87, which is located on the opposite side of another of the third chamber walls 72 containing the second opening 77. A buffer gas, which may comprise $H_2$, He, Ne, Ar, Kr, $N_2$, etc., are flowed through a gas flow control device 74 through the buffer gas inlet 73 into the third chamber 80. The gas flow control device 74 may be a mass flow controller, an adjustable valve, or a restriction valve. The third chamber 80 is maintained at a third pressure, which is slightly higher than the second pressure of the second chamber 60. The third pressure may be from about 5 mTorr to about 300 mTorr, and preferably from about 1 mTorr to about 100 mTorr, although lesser and greater values for the third pressure are contemplated herein also. The third pressure may be inferred from measurement on the second pressure.

The geometry of the structures within the third chamber 80 is optimized so that the buffer gas flows toward the second opening 77. For example, the dimensions of the third opening 87 are set to be smaller than the dimensions of the second opening 77. For example, the dimensions, e.g., the diameter, of the third opening 87 may be from about 0.6 mm to about 6 cm, and typically from about 1.8 mm to about 2 cm, so that the buffer gas exists the third chamber predominantly through the second opening 77 instead of the third opening 87. The charged particles that move down along the central cavity of the multipole ion guide 86 are slowed within the third chamber 80 upon entry through the second opening 77 into the third chamber 80. The buffer gas provides an upward momentum transfer to the charged particles that move down the central cavity of the multipole ion guide 86 toward the third opening 87.

Once captured in the multipole ion guide 86 as a focused particle beam, the charged particles undergo many collisions with the buffer gas during descent down the center cavity of the multipole ion guide 86. In other words, collisions of the charged particles with the buffer gas inside the third chamber 80 abate the forward motion, or a downward motion, of the charged particles, while the multipole ion guide 86 collimates the charged particles along the central axis of the multipole ion guide 86. As the kinetic energy is taken away from the charged particles, the trajectory of the charged particles converge on the axis of the multipole ion guide as the charged particles, i.e., ions, loses kinetic energy and move to the middle of the center cavity of the multipole ion guide 86.

Preferably, at least one electrode, to which electric potential is applied, is provided in the third chamber 80 to facilitate the convergence, and the subsequent accumulation, of the charged particles to the middle of the center cavity of the multipole ion guide 86. For example, a first end cap electrode 82 may be formed near the second opening 77, and a second end cap electrode 84 may be formed near the third opening 87. Each of the first end cap electrode 82 and the second end cap electrode 84 contains a hole to allow passage of the charged particles therethrough. The holes of the first end cap electrode 82 and the second end cap electrode 84 are aligned to the axis connecting the center of the second opening 77 with the center of the third opening 87, which may be coincident with the axis of the multipole ion guide 86.

A first high transmittance conductive mesh 83 and a second high transmittance conductive mesh 85 may be provided adjacent to the openings in the first end cap electrode 82 and the second end cap electrode 84, respectively. The first and second high transmittance conductive meshes (83, 85) encompass at least the area of the openings of the first end cap electrode 82 and the second end cap electrode 84, respectively. Preferably, the same electric potential is applied to the first high transmittance conductive mesh 83 as to the first end cap electrode 82, and the same electric potential is applied to the second high transmittance conductive mesh 85 as to the second end cap electrode 84. The first and second high transmittance conductive meshes (83, 85) flatten the electric field at the ends of the multipole ion guide 86. The ratio of the area between the wires of the first and second high transmittance conductive meshes (83, 85) and the area occupied by the wires of the first and second high transmittance conductive meshes (83, 85) is kept as high as possible to provide a high transmittance.

Optionally, charged particles, i.e., ions, may be mass selected in the multipole ion guide 86 so that a larger concentration of the charged particles of interest may be delivered into the fourth chamber 90 through the third opening 87. Such a feature is advantageous if analysis of charged particles with a large atomic mass is performed in the fourth chamber 90. For example, the analysis may be protein analysis by mass spectroscopy, in which the concentration of various protein molecules may vary by as much as six orders of magnitude.

Preferably, the charged particles are extracted from the multipole ion guide 86 by changing the electrical potential on the first and second end cap electrodes (82, 84). In this case, a large diameter is preferred for the multipole ion guide 86 because such a large diameter enables deep penetration of the electrical field generated by the first and second end cap electrodes (82, 84), which is referred to as an end cap electric field, into the multipole ion guide 86. Such deep penetration of the end cap electric field permits efficient extraction of the charged particles from the multipole ion guide 86 with excellent control of the kinetic energy of the charged particles.

Thus, charged particles with extremely low kinetic energy may be selectively extracted through the third opening 87 into the fourth chamber 90. In case the vacuum instrumentation 95 comprises a mass spectrometer, well-controlled injection of low-kinetic energy charged particles into the fourth chamber 90 enables precise control of the trajectory of the charged particles by the electromagnetic field of the mass spectrometer even for charged particles with a high atomic mass. When the trajectories of the charged particles are completely defined by the applied electromagnetic field, accurate high resolution mass measurement may be made for charged particle having a high mass-to-charge ratio.

Employing a multipole ion guide 86 having a large radius provides an additional benefit of accumulation of a large number of charged particles. Such an accumulation enables a higher flux of charged particles into the fourth chamber so that measurement of a large range of concentrations for the particle species may be performed.

The capture efficiency, or the ratio of the flux of the charged particles through the third opening 87 to the flux of the charged particles through the first opening 39, is determined by several factors including the radial divergence angle of the first chamber walls 32 near the first opening 39, the velocity distribution of the charged particles, the mass-to-charge ratio of the charged particles, the frequency and voltages of the electrical signal applied to both the multipole ion guide 86 and to the first and second end cap electrodes (82, 84), and buffer gas pressure. The pressure inside the third chamber 80 may be adjusted by adding additional gas to the third chamber and/or throttling the second chamber vacuum pump 66 to optimize the ion capture efficiency. In practice, using large radius multipoles permits greater trapping of larger particles. The combination of the control of the expansion of the laminar flow at the adjustable expansion slit 37, the gas pressure in the third chamber 80, and the radius of the multipole ion guide 86 are key elements in achieving efficient capture of a large quantity of charged particles, i.e., ions, of any size.

The unique feature of this method of slowing down the charged particles is that there is no mass dependence for slowing the particles down. The prior art method described in U.S. Pat. No. 6,972,408 had a reverse jet pressure dependence of retardation of particle speed, in which particles within only a relatively narrow range of atomic mass are slowed. The present invention eliminates such a problem since the mechanism for the slowing of the charged particles is by a momentum transfer by the buffer gas. The present invention permits the capture and storage of a large quantity of charged particles over a vast range of mass-to-charge ratios for a subsequent controlled injection into a fourth chamber 90, which contains vacuum instrumentation 95. In case the vacuum instrumentation comprises a mass spectrometer, an accurate high resolution measurement of atomic mass of the charged particles over an enormous range of atomic mass is enabled well above 200 kDa, and even beyond the range of 10 GDa.

Figure 6:
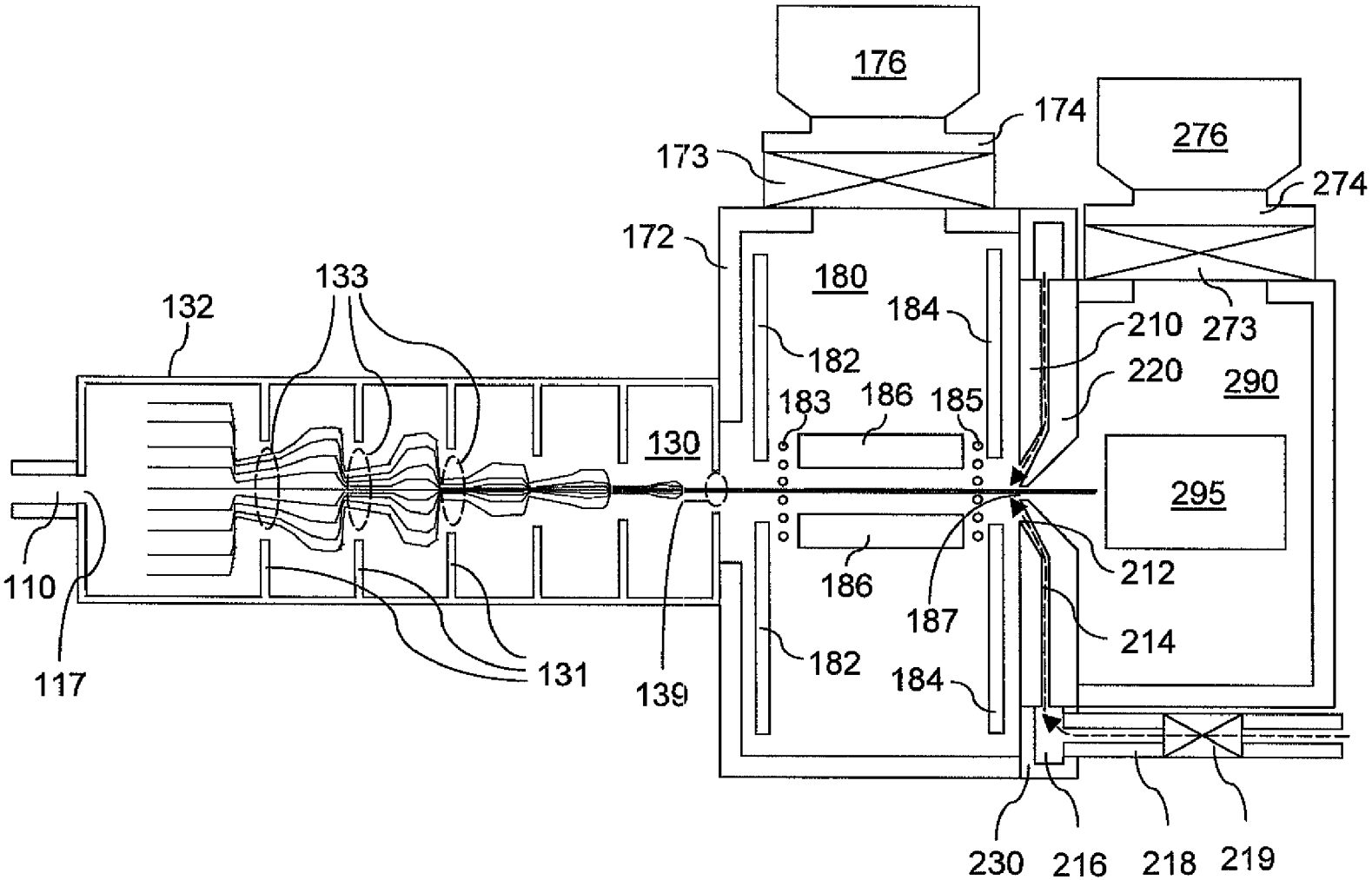
FIG. 6 is a vertical cross-sectional view of a second exemplary particle inlet system comprising a first chamber 130, a second chamber 180, and a third chamber 290 according to a second embodiment of the present invention.

Referring to FIG. 6, a vertical cross-sectional view of a second exemplary particle inlet system according to a second embodiment of the present invention is shown, which comprises a first chamber 130, a second chamber 180, and a third chamber 290. The second exemplary particle inlet system is employed to deliver near-zero kinetic energy particles into the third chamber 290 which houses vacuum instrumentation 295. The vacuum instrumentation 295 may be any type of vacuum compatible instrument, and may be an analytical device. Preferably, the vacuum instrumentation 295 is a vacuum compatible instrument that benefits from low kinetic energy of particles. Particularly, the vacuum instrumentation 295 may be a mass spectrometer, of which the resolution or sensitivity is enhanced when the kinetic energy of the particles is lowered. When the kinetic energy of the particles is near-zero as in the present invention, the mass spectrometer provides high resolution even for particles having a high atomic mass, e.g., over 200 kDa.

An aerosol of particles is introduced with a carrier gas from a gas inlet assembly 110 through a gas inlet orifice 117 into the first chamber 130 of the second exemplary particle inlet system. Preferably, the gas inlet orifice 117 is a flow limiting orifice. The dimension, e.g., a diameter, of the gas inlet orifice 117 may be from about 10 μm to about 1 mm, and typically from about 30 μm to about 300 μm, although lesser and greater dimensions are contemplated herein also. The particles may, or may not, be charged when admitted into the first chamber 130. In case the vacuum instrumentation 295 comprises a mass spectrometer, the particles are preferably electrically charged prior to entry into the first chamber 130. The aerosol of particles expands into the first chamber 130 at a reduced pressure, i.e., a lower pressure than the pressure at the gas inlet assembly 110, which may be at an atmospheric pressure.

The first chamber 130 is enclosed by first chamber walls 132, and is connected to the gas inlet assembly 110 through the gas inlet orifice 117 and to the second chamber 180 through a first opening 139, which is located on one of first chamber walls that is located on the opposite side of the gas inlet assembly 110. Other than the gas inlet orifice 117 and the first opening 139, the first chamber 130 is vacuum tight.

The second chamber 180 is connected to the first chamber 130 through the first opening 139. The second chamber 180 is pumped by a second chamber vacuum pump 176, which is mounted to second chamber walls 172 through a second chamber mounting flange 174 and a second chamber gate valve 173, while no pump is directly mounted on the first chamber 130. To reduce load on the second chamber vacuum pump 176, the second chamber gate valve 173 is typically operated at a partially open state. The pressure of the first chamber 130, which is herein referred to as a first pressure, is higher than the pressure of the second chamber 180, which is herein referred to as a second pressure. Typically, the first pressure is maintained in the range from about 1 Torr to about 5 Torr, and the second pressure is maintained in the range from about 1 mTorr to about 100 mTorr, although lesser and greater values are contemplated for the first pressure and the second pressure also.

A third chamber vacuum pump 276 is connected to third chamber walls through a third chamber mounting flange 274 and a third chamber gate valve 273. Typically, the third chamber gate valve 273 is operated at a finally open state to provide high vacuum to the third chamber 290.

The first chamber 130 constitutes an aerodynamic lens system that forms a focused aerosol beam from the particles injected through the gas inlet orifice 117. A plurality of plates 131, each having a plate opening 133, is located between the gas inlet orifice 117 and the first opening 139. The gas inlet orifice 117, an entirety of the plate openings 133, and the first opening 139 are coaxially aligned. A laminar flow is formed in the first chamber 130 according to fluid dynamics of the particles and the carrier gas molecules. Since each of the plurality of plates 131 provides a boundary for the laminar flow, the flow of the charged particles becomes a tightly-collimated beam by the time the particles reach the first opening 139. Thus, the aerodynamic lens system, formed by the geometry of the first chamber 130, delivers a highly directional beam of particles into the second chamber 180. The laminar flow is controlled by the geometry of the first chamber 130 and the pressure of the second chamber 180. The distance between the gas inlet orifice 117 and the first opening 139 may be from about 5 cm to about 3 m, and preferably from about 15 nm to about 1 m, although lesser and greater distances are contemplated herein also.

The particles move into the second chamber 180 through the first opening 139. The shape of the first opening 139 may, or may not, have a 180 degree rotational symmetry. Preferably, the shape of the first opening 139 has a 180 degree rotational symmetry. The dimension, e.g., the diameter, of the first opening 139 may be from about 0.3 mm to about 3 cm, and typically from about 1 mm to about 1 cm, although lesser and greater thicknesses are contemplated herein also.

The particles subsequently move through the second chamber 180 to a third opening 187 located at the center of a jet nozzle housing embedding a conical jet nozzle 212. In the second chamber 180, the second opening 187 is located on an opposite side of the first opening 139. The gas inlet orifice 117, the first opening 39, and the second opening 187 may be located on a same axis. The third chamber 290 is connected to the second chamber 180 through the second opening 187. The third chamber 290 comprises vacuum instrumentation 295, which may be, for example, a mass spectrometer. A third chamber vacuum pump 276 mounted to the third chamber 290 through a third chamber mounting flange 274 provides pumping to the third chamber 290. The third chamber 290 is maintained at a third pressure, which is less than 100 mTorr, and typically less than 10 mTorr.

For the purposes of application of the second exemplary particle inlet system in a mass spectrometry system, charged particles are employed for injection into the first chamber 130, and subsequent flow into the second chamber 180 and the third chamber 290. A multipole ion guide 186 is provided within the second chamber 180. The multipole ion guide 186 guides comprises a plurality of poles surrounding a central cavity through which charged ions move. The structure and operation of the multipole ion guide 186 are the same as in the first embodiment of the present invention described above.

The charged particles that move into the second chamber 180 may still have some lateral momentum since the momentum of individual charged particles as they enter the second chamber 180 has a statistical distribution. In other words, while the average lateral momentum, i.e., the momentum in the plane perpendicular to the direction of the beam of the charged particles, of the particles is zero, the individual charged particles may have a distribution of non-zero lateral momentum. Thus, the momentum of the charged particles entering the center cavity of the multipole ion guide 186 may have a small magnitude of divergent component, i.e., a non-collimated component despite the aerodynamic lens system of the first chamber 130. In other words, the imperfection of the aerodynamic lens system allows a finite distribution of lateral momentum in the plane perpendicular to the direction of the charged particles.

The electromagnetic field of the multipole ion guide 186 focuses the charged particles as a directional beam along the central axis of the multipole ion guide 86. Any small magnitude of lateral momentum in the charged particles is lost as the charged particles travel through the second chamber 180, and become even more collimated due to the electromagnetic field of the multipole ion guide 186. The structure and dimensions of the multipole ion guide 186 is the same as the structure and dimensions of the multipole ion guide 86 in the first embodiment.

Figure 7B:
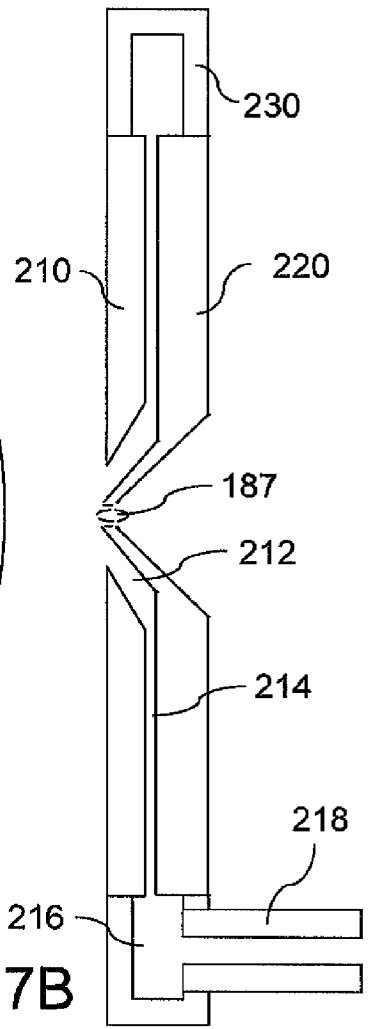
FIG. 7B is a vertical cross-sectional view of the jet nozzle housing according to the second embodiment of the present invention.
Figure 7A:
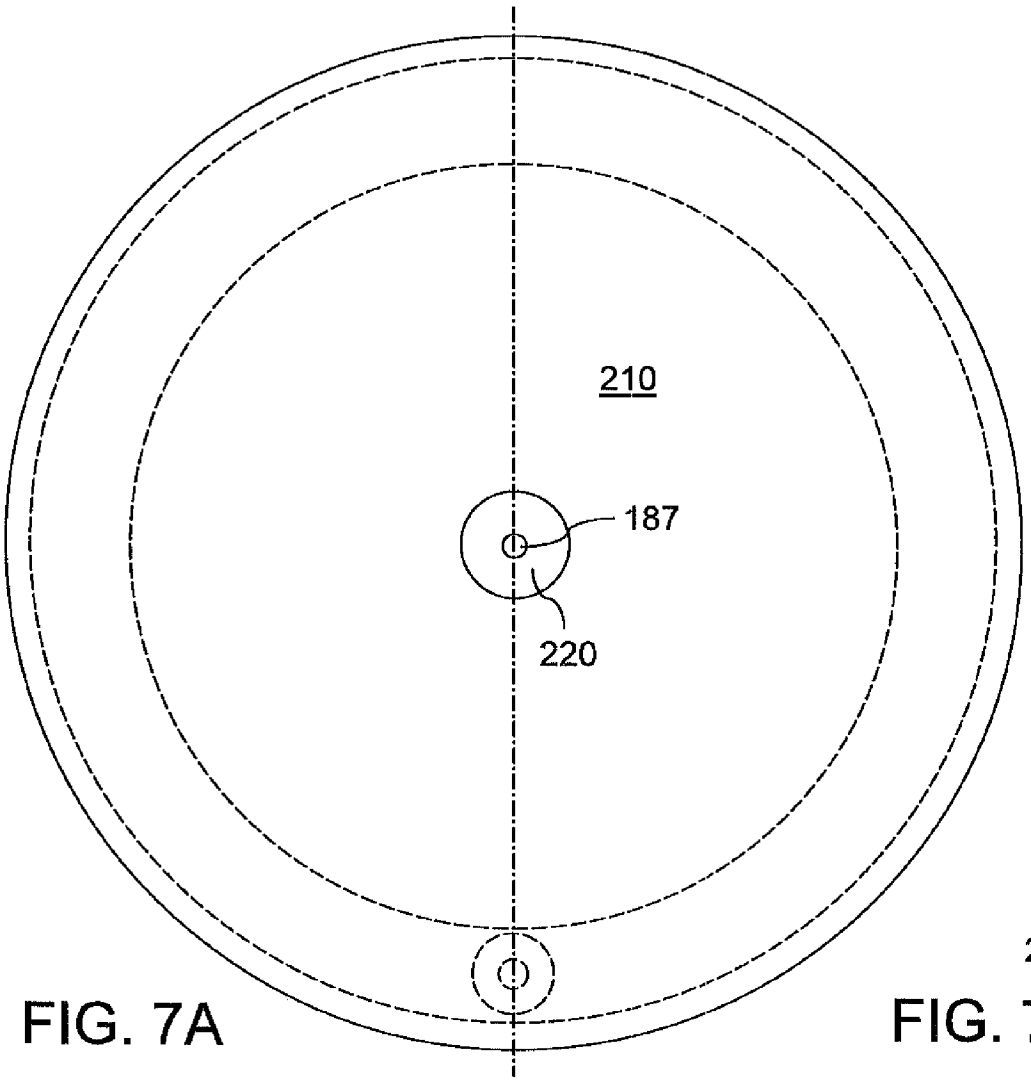
FIG. 7A is a side view of a jet nozzle housing according to the second embodiment of the present invention.

The structure of the jet nozzle housing is illustrated in FIGS. 7A and 7B. FIG. 7A is a magnified side view of the jet nozzle housing as seen from the direction of the first opening 139, e.g., from the middle of the multipole ion guide 186. FIG. 7B is a magnified view of the vertical cross-sectional view of the jet nozzle housing. The jet nozzle housing comprises an upper plate 210 exposed to the second chamber 180, a lower plate 220 separated from the upper plate 210 by the conical jet nozzle 220 and a planar separation space 214 having a constant width, and a toroidal outer frame 230 adjoined to the upper plate 210 and the lower plate 220 and enclosing a toroidal gas chamber 216, which is radially connected to the conical jet nozzle 212 through the planar separation space 214.

The conical jet nozzle 212 has a shape of a truncated cone, of which the truncated apex is coincident with a point at the center of the charged particle beam. The located of the charged particle beam is the center axis of the multipole ion guide 186, i.e., the axis of the center cavity of the multipole ion guide 186. The conical jet nozzle 212, the planar separation space 214, and the toroidal gas chamber 216 form a contiguous space. Preferably, the set of the conical jet nozzle 212, the planar separation space 214, and the toroidal gas chamber 216 has a cylindrical symmetry around the center axis of the multipole ion guide 186. The second opening 187 is located at the center of the jet nozzle housing (210, 220, 230). The second opening 187, the opening of the conical jet nozzle 212, and the toroidal gas chamber 216 are concentric, and the center of these structures coincide with the center axis of the multipole ion guide 186.

A buffer gas inlet 218 is provided on the toroidal gas chamber 216. A buffer gas, which may comprise $H_2$, He, Ne, Ar, Kr, $N_2$, etc., are flowed through a gas flow control device 219 through the buffer gas inlet 218 into the toroidal gas chamber 216. The gas flow control device 219 may be a mass flow controller, an adjustable valve, or a restriction valve. The toroidal gas chamber 216, the planar separation spacer 214, and the conical jet nozzle 212 are maintained at a pressure higher than the second pressure of the second chamber 180. The pressure of the conical jet nozzle 212 may be from about 5 mTorr to about 300 mTorr, and preferably from about 10 mTorr to about 100 mTorr, although lesser and greater values for the third pressure are contemplated herein also.

A reverse jet of the buffer gas is provided through the conical jet nozzle 212 into the second chamber 180. Typically, the area of the orifice of the conical jet nozzle 212 is equivalent to the area of the first opening 139, which is the area of the nozzle provided by the aerodynamic lens system of the first chamber 130. The buffer gas flux of the reverse jet may be adjusted so that the total momentum flux of the reverse jet of the buffer gas is equal in magnitude as, and has the opposite direction of, the total momentum flux of the charged particles in the multipole ion guide 186. Such a setting enables reduction of the momentum of the charged particles to near zero in the multipole ion guide 186. After a predefined collection time, the reverse jet may be temporarily stopped to permit injection of the charged particles that have been trapped in the multipole ion guide 186 to be injected into the third chamber 290. The charged particles injected into the third chamber 290 do not have any residual expansion-induced kinetic energy regardless of mass.

The conical geometry of the conical jet nozzle 212 enables convergent delivery of the buffer gas on a point in the path of the charged particles in the second chamber 180. The lateral momentum of the buffer gas is cancelled since the conical jet nozzle 212 is cylindrically symmetric about an axis defined by the charged particle beam, and as a consequence, the flow of the buffer gas into the second chamber is also cylindrically symmetric about the axis defined by the charged particle beam, which is the axis of the multipole ion guide 186. Thus, there is no mechanism to generate an aerodynamic vortex in the second chamber 180.

The buffer gas provides a net momentum transfer to the charged particles that move down the central cavity of the multipole ion guide 86 toward the second opening 187 in the direction opposite to the movement of the charged particles. The net momentum of the buffer gas in the axial direction is adjusted to almost cancel out the momentum of the charged particle beam so that the charged particles lose kinetic energy while approaching the third opening 187. By the time the charged particles reach the third opening 187, the kinetic energy of the charged particles is near zero.

Preferably, the dimensions, e.g., the diameter, of the third opening 87 are optimized to facilitate the removal of the carrier gas molecules and the buffer gas through the second chamber vacuum pump 176. For example, the dimensions, e.g., the diameter, of the third opening 87 may be from about 0.6 mm to about 6 cm, and typically from about 1 mm to about 1 cm, so that the buffer gas exits the second chamber 180 predominantly through the second chamber vacuum pump instead of the second opening 187.

Preferably, at least one electrode, to which electric potential is applied, is provided in the second chamber 180 to facilitate the convergence, and the subsequent accumulation, of the charged particles to the middle of the center cavity of the multipole ion guide 186. For example, a first end cap electrode 182 may be formed near the first opening 139, and a second end cap electrode 184 may be formed near the second opening 187. Each of the first end cap electrode 182 and the second end cap electrode 184 contains a hole to allow passage of the charged particles therethrough. The holes of the first end cap electrode 182 and the second end cap electrode 184 are aligned to the axis connecting the center of the first opening 139 with the center of the second opening 187, which may be coincident with the axis of the multipole ion guide 86.

A first high transmittance conductive mesh 183 and a second high transmittance conductive mesh 185 may be provided adjacent to the openings in the first end cap electrode 182 and the second end cap electrode 184, respectively. The first and second high transmittance conductive meshes (183, 185) encompass at least the area of the openings of the first end cap electrode 182 and the second end cap electrode 184, respectively. Preferably, the same electric potential is applied to the first high transmittance conductive mesh 183 as to the first end cap electrode 182, and the same electric potential is applied to the second high transmittance conductive mesh 85 as to the second end cap electrode 184. The first and second high transmittance conductive meshes (183, 185) flatten the electric field at the ends of the multipole ion guide 186. The ratio of the area between the wires of the first and second high transmittance conductive meshes (183, 185) and the area occupied by the wires of the first and second high transmittance conductive meshes (183, 85) is kept as high as possible to provide a high transmittance.

Optionally, charged particles, i.e., ions, may be mass selected in the multipole ion guide 186 so that a larger concentration of the charged particles of interest may be delivered into the third chamber 290 through the second opening 187. Such a feature is advantageous if analysis of charged particles with a large atomic mass is performed in the third chamber 290. For example, the analysis may be protein analysis by mass spectroscopy.

Preferably, the charged particles are extracted from the multipole ion guide 186 by changing the electrical potential on the first and second end cap electrodes (182, 184). In this case, a large diameter is preferred for the multipole ion guide 186 because such a large diameter enables deep penetration of the electrical field generated by the first and second end cap electrodes (182, 184) as described in the first embodiment. In case the vacuum instrumentation 295 comprises a mass spectrometer, well-controlled injection of low-kinetic energy charged particles into the third chamber 290 enables precise control of the trajectory of the charged particles by the electromagnetic field of the mass spectrometer even for charged particles with a high atomic mass. When the trajectories of the charged particles are completely defined by the applied electromagnetic field, accurate high resolution mass measurement may be made for charged particle having a high mass-to-charge ratio.

The capture efficiency, or the ratio of the flux of the charged particles through the second opening 187 to the flux of the charged particles through the first opening 139, is determined by several factors including the velocity distribution of the charged particles, the mass-to-charge ratio of the charged particles, the frequency and voltages of the electrical signal applied to both the multipole ion guide 186 and to the first and second end cap electrodes (182, 184), buffer gas pressure, the opening area and the angle of the conical jet nozzle 212, and the pressure of the second chamber 180. The pressure inside the second chamber 180 may be adjusted by adding additional gas to the second chamber 180 and/or throttling the second chamber vacuum pump 176 to optimize the ion capture efficiency. The combination of the control of the directionality and the average velocity of the charged particles from the first chamber 130 into the second chamber 180, the gas pressure in the second chamber 180, and the radius of the multipole ion guide 186 are key elements in achieving efficient capture of a large quantity of charged particles, i.e., ions, of any size.

Hybrid embodiments employing various elements of the first exemplary particle inlet system and the second exemplary particle inlet system are mixed are contemplated herein also. For example, the first chamber 30 of the first exemplary particle inlet system may replace the aerodynamic lens system implemented as the first chamber 130 in the second exemplary particle inlet system. Also, the set of the second chamber 60 and the third chamber 80 and the peripheral elements attached thereto in the first exemplary particle inlet system may replace the second chamber 180 and the peripheral elements attached thereto in the second exemplary particle inlet system. Further, embodiments in which various axes are tilted relative to another axis are contemplated herein also. Such axes include the axes connecting the various openings for the flow of particles in the exemplary particle inlet systems.

While the invention has been described in terms of specific embodiments, it is evident in view of the foregoing description that numerous alternatives, modifications and variations will be apparent to those skilled in the art. Accordingly, the invention is intended to encompass all such alternatives, modifications and variations which fall within the scope and spirit of the invention and the following claims.

What is claimed is:

1. A particle inlet system for vacuum instrumentation, said particle inlet system comprising:

a first chamber comprising a gas inlet orifice and an expansion slit located over a plate containing a first opening, wherein a height of said expansion slit is adjustable in a direction along a direction perpendicular to a flat surface of said plate;

a second chamber connected to said first chamber at said first opening and comprising a second opening located directly underneath said first opening; and a vacuum pump connected to, and configured to pump on, said second chamber.

2. The particle inlet system for vacuum instrumentation of claim 1, further comprising a third chamber connected to said second chamber at said second opening.

3. The particle inlet system of claim 2, further comprising a buffer gas inlet connected directly to said third chamber.

4. The particle inlet system of claim 3, wherein said second opening is located in a first chamber wall of said third chamber, wherein said buffer gas inlet is located on a second chamber wall of said third chamber located on an opposite side of said first chamber wall.

5. The particle inlet system of claim 2, further comprising:

a fourth chamber connected to said third chamber through a third opening, wherein said third opening is located on an opposite side of said second opening on said third chamber; and another vacuum pump connected to, and configured to pump on, said fourth chamber.

6. The particle inlet system of claim 5, further comprising:

a multipole ion guide located in said third chamber; and a set of electrical feedthroughs connected to electrodes of said multipole ion guide, wherein a cavity in said multipole ion guide is aligned to an axis connecting said second opening to said third opening.

7. The particle inlet system of claim 5, further comprising at least one electrode containing an electrode hole aligned to an axis connecting said second opening to said third opening.

8. The particle inlet system of claim 5, wherein said first opening, said second opening, and said third opening are located on a same axis.

9. The particle inlet system of claim 1, wherein said expansion slit has a 180 degree rotational symmetry around an axis perpendicular to said flat surface.

10. The particle inlet system of claim 9, wherein said first opening has a shape with a 180 degree rotational symmetry around said axis perpendicular to said flat surface.

11. The particle inlet system of claim 1, further comprising a micrometer, wherein a spindle of said micrometer is located over said first opening and a thimble of said micrometer is located outside said first chamber.

12. The particle inlet system of claim 11, wherein said micrometer is configured to enable complete blocking of said first opening.

13. The particle inlet system of claim 11, wherein said first opening has a shape with a 180 degree rotational symmetry around an axis perpendicular to said flat surface, and wherein an axis of said spindle of said micrometer is coincidental with said axis.

14. The particle inlet system of claim 11, wherein said height of said expansion slit is equal to a distance between said spindle of said micrometer and said flat surface of said plate.

15. The particle inlet system of claim 11, said expansion slit has a shape of a sidewall surface of a circular cylinder having a radius equal to a radius of said spindle of said micrometer.

16. The particle inlet system of claim 1, further comprising an expansion chamber located between said first chamber and said second chamber and including first-chamber-side openings and at least one second-chamber-side opening, wherein said first-chamber-side openings are located on sidewalls of said expansion chamber with a 360/n degree rotational symmetry, wherein n is an integer greater than 1.

17. The particle inlet system of claim 16, wherein said at least one second-chamber-side opening has a 360/m degree rotational symmetry about a same axis of rotational symmetry as said first-chamber-side openings, wherein m is an integer greater than 1.

18. The particle inlet system of claim 17, wherein said at least one second-chamber-side opening has an axial symmetry about said same axis of rotational symmetry.

19. A mass spectrometry system comprising:

a first chamber comprising a gas inlet orifice and an expansion slit located over a plate containing a first opening, wherein a height of said expansion slit is adjustable in a direction along a direction perpendicular to a flat surface of said plate;

a second chamber connected to said first chamber at said first opening and comprising a second opening located directly underneath said first opening;

a vacuum pump connected to, and configured to pump on, said second chamber;

a third chamber comprising a third opening and connected to said second chamber at said second opening;

a fourth chamber connected to said third chamber at said third opening; and a mass spectrometer located in said fourth chamber.

20. The mass spectrometry system of claim 19, further comprising a micrometer, wherein a spindle of said micrometer is located over said first opening and a thimble of said micrometer is located outside said first chamber.

21. The mass spectrometry system of claim 19, wherein said first opening, said second opening, and said third opening are aligned on a same axis.

22. The mass spectrometry system of claim 21, further comprising a micrometer, wherein an axis of said spindle of said micrometer is coincidental with said same axis.

* * * * *

UNITED STATES PATENT AND TRADEMARK OFFICE

CERTIFICATE OF CORRECTION

PATENT NO. : 7,851,750 B2
APPLICATION NO. : 12/100001
DATED : December 14, 2010
INVENTOR(S) : Peter T. A. Reilly It is certified that error appears in the above-identified patent and that said Letters Patent is hereby corrected as shown below:

On the Title Page Item (73) Assignee: should read:

UT-BATTELLE, LLC
Oak Ridge, Tennessee

Signed and Sealed this
Fourteenth Day of June, 2011

David J. Kappos

David J. Kappos
*Director of the United States Patent and Trademark Office*